US006351248B1

(12) United States Patent
Hill

(10) Patent No.: US 6,351,248 B1
(45) Date of Patent: Feb. 26, 2002

(54) DIRECTIONAL ANTENNA

(75) Inventor: David A. Hill, Cordova, TN (US)

(73) Assignee: BellSouth Intellectual Property Management Corp., Wilmington, DE (US)

( * ) Notice: Subject to any disclaimer, the term of this patent is extended or adjusted under 35 U.S.C. 154(b) by 0 days.

(21) Appl. No.: 09/604,753

(22) Filed: Jun. 28, 2000

(51) Int. Cl.[7] ..... H01Q 1/42; H01Q 13/18
(52) U.S. Cl. ..... 343/834; 343/789
(58) Field of Search ..... 343/834, 789, 343/790, 792.5, 872, 898

(56) References Cited

U.S. PATENT DOCUMENTS 2,624,843 A * 1/1953 Redheffer ..... 250/33
3,975,737 A * 8/1976 Jones, Jr. et al. ..... 343/770

* cited by examiner

*Primary Examiner*—Don Wong
*Assistant Examiner*—James Clinger
(74) *Attorney, Agent, or Firm*—Shaw Pittman, LLP

(57) ABSTRACT

A directional antenna designed to reduce the occurrence of side lobes, thus reducing the possibility of interference with other radio frequencies is disclosed. The directional antenna includes an antenna member and a reflecting tube. The reflective tube is sleeved over the antenna member. The reflective serves to block unwanted radial side lobes. The directional antenna can also include provisions that assist in suspending the antenna member within the reflective tube. A method for making the directional antenna is also described.

19 Claims, 7 Drawing Sheets

DIRECTIONAL ANTENNA

BACKGROUND

1. Field of the Invention

The present invention relates to an antenna, and more particularly, to a directional antenna.

2. Background of the Invention

An antenna is the heart of a wireless communications system. Antennas in transmitters convert electrical signals into airborne radio frequency (RF) waves, and in receivers they convert airborne waves into electrical signals. Without antennas there are no wireless communications.

The size of an antenna depends on the radio frequency for which the antenna is designed. The higher the frequency, the smaller the antenna. Therefore, wireless telephones use small antennas to communicate at high frequencies. Because there is a finite range of high frequencies that is allocated for wireless communications, a wireless service provider must reuse some or all of its allocated frequencies to increase call handling capacity, i.e., to enable more customers to use their wireless telephones at the same time in the same service area.

To reuse frequencies, a wireless service provider divides its service area into "cells," and it equips each of the cells with a low-powered antenna system. Antenna systems in two non-adjacent cells may use the same frequency. Cells generally fall into three categories: "macrocells," "microcells," and "picocells." A macrocell covers a relatively large area (e.g., about 50-mile radius), and it is optimized to serve users who are highly mobile such as those in automobiles. A microcell covers a smaller area (e.g., about 10-mile radius), and it is optimized for wireless device users who are less mobile such as pedestrians. A picocell covers an even smaller area (e.g., a tunnel or a parking garage). The antenna system for a picocell requires extremely low output power but it can direct cellular signal into an isolated spot such as a low-lying, tree-covered road intersection.

An antenna system at each picocell typically has a donor antenna, a signal-processing device such as an amplifier (for analog signals) or a repeater (for digital signals), and a coverage antenna. These three components are serially connected by coaxial cables. The components are typically mounted on a utility pole that is about 40 to 50 feet tall. The donor antenna receives downlink signals from a macrocell site (also known as the donor cell site) and channels the downlink signals to the signal-processing device. The signal-processing device either amplifies or repeats the downlink signals before the coverage antenna broadcasts the downlink signals to the vicinity of the picocell. Similarly, the coverage antenna receives uplink signals from the vicinity of the picocell and the donor antenna re-transmits the uplink signals to the macrocell site after the amplifier or the repeater has processed the uplink signals. The donor antenna is typically a directional antenna that has a clear line of sight to the donor cell site. On the other hand, the coverage antenna is typically an omnidirectional antenna that has a 360-degree "view" of the picocell. To maximize signal reception and coverage, both antennas must be mounted as high as possible.

Each of the donor and coverage antennas has its own RF patterns that are often known as side lobes. The side lobes of the donor antenna often overlap with the side lobes of the coverage antenna, resulting in a signal looping effect. As a result, the signal-processing device is often saturated by signals looping between the two antennas. The saturation situation causes the antenna system to shut down.

One solution to reduce the looping effect is to separate the donor antenna from the coverage antenna as far as possible. However, the existing antenna technology still does not offer a satisfactory solution to the looping effect due to the following constraints. First, the antennas cannot be separated more than twenty feet apart on a utility pole that is about 40 to 50 feet high. Second, existing antennas are bulky and heavy, making them difficult to mount at higher locations. Third, existing antennas have large cross-sections that are not desirable at higher altitudes due to wind loading. Fourth, extending the height of the utility pole is not desirable due to cost, environmental, and aesthetic concerns.

SUMMARY OF THE INVENTION

The present invention is a highly directional antenna. The antenna of the present invention reduces side lobes and thereby minimizing signal looping effect with an adjacent antenna such as a coverage antenna in an antenna system. The antenna of the present invention has an antenna element enclosed in a reflective tube, the interior of which is lined with a reflective material that shields radio frequencies.

The reflective tube is generally tubular in shape. The cross-section of the reflective tube may be circular, oval or polygonal. The reflective tube encloses or surrounds the antenna element. In the preferred embodiment, the reflective tube is generally made of a lightweight material, and the reflective material is a layer of metallic paint. In one preferred embodiment, the antenna of the present invention is used as a donor antenna, and it is mounted on a utility pole as part of an antenna system that also comprises a coverage antenna. In another preferred embodiment, the antenna of the invention is used as a donor antenna mounted on a first utility pole, while a coverage antenna is mounted on a second utility pole.

It is an object of the invention to provide an antenna that is highly directional.

It is another object of the invention to provide a directional antenna with little or no side lobe overlaps with another antenna.

It is another object of the invention to provide an antenna that is lightweight.

It is another object of the invention to an antenna that has a small wind loading cross section.

It is another object of the invention to provide an antenna system that is aesthetic looking and environmentally friendly.

It is another object of the invention to mount an antenna system comprising a donor antenna and a coverage antenna on one utility pole without the undesirable signal looping effect.

These and other objects of the present invention are described in greater detail in the detailed description of the invention, the appended drawings, and the attached claims.

DETAILED DESCRIPTION OF PREFERRED EMBODIMENTS

Figure 1:
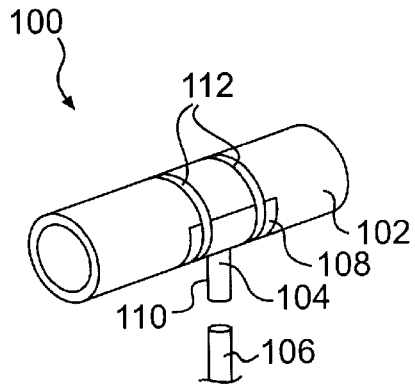
FIG. 1 is a schematic diagram of an isometric view of a preferred embodiment of the invention.

FIG. 1 is a schematic diagram of an isometric view of a preferred embodiment of the invention. Directional antenna 100 includes a reflective tube 102 and an adapter 104 that is designed to mate with a mast 106. In one embodiment, adapter 104 preferably includes a curved portion 108 that substantially corresponds to the curve of reflective tube 102, and a mating portion 110 that is designed to mate with mast 106. Adapter 104 can be attached to reflective tube 102 by a series of bands 112. Bands 112 are preferably made of a corrosion resistant material, for example, stainless steel. In another embodiment, adapter 104 and reflective tube 102 are formed as a single, monolithic unit. In other embodiments not shown in the drawings, reflective tube 102 may be any geometrical shape other than the cylindrical shape shown. For example, reflective tube 102 may be a block or an ellipsoid that is substantially tubular with a cross-section of a polygon and an oval, respectively.

Preferably, the antenna is sized such that it is large enough to provide reception and transmission, but small enough to reduce wind loading area. Based on these competing considerations, the antenna can be sized accordingly. In an exemplary embodiment of the invention, the antenna has a length of about 33 inches and a radius of about five inches.

Figure 2:
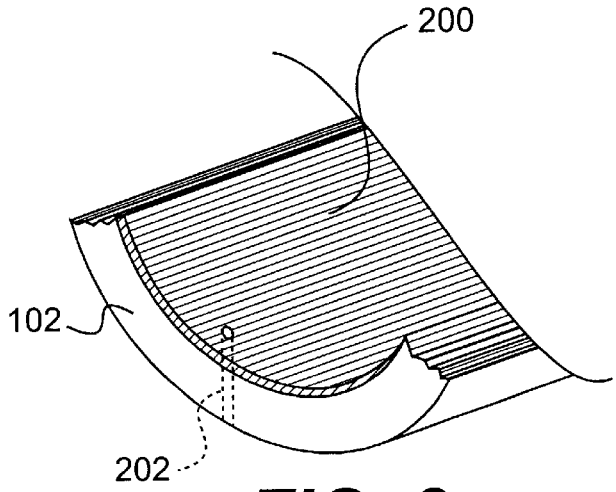
FIG. 2 is a schematic diagram of a cut away view of the preferred embodiment of the invention.

FIG. 2 is a schematic diagram of a cut away view of reflective tube 102. A reflective material 200 is preferably disposed on the inside of reflective tube 102. The reflective material 200 is any material that can block or inhibit any wave or signal on the electromagnetic spectrum. Many materials can be used as the reflective material 200. Preferably, reflective material 200 is selected so that radio frequencies (RF) are blocked or inhibited. A material that is easy to place inside reflective tube 102 is also preferred. In exemplary embodiments of the present invention, a copper mesh, an aluminum tape, and/or a metallic coating are used as reflective material 200. The metallic coating is preferably a metallic marine paint, for example, a copper paint. Reflective tube 102, a housing upon which reflective material 200 is disposed, may be made of any materials. In the preferred embodiment, reflective tube 102 is made of a fiberglass compound.

FIG. 2 also shows a weep hole 202. This hole assists in removing any moisture or water, for example, rain, snow or condensation, that may accumulate inside reflective tube 102. Weep hole 202 can be disposed in the tube, as shown in FIG. 2, or weep hole 202 can be disposed on end caps 302*a* and 302*b* (see FIG. 3). Weep hole 202 can be disposed in any desired location in reflective tube 102. Preferably, two weep holes 202 are disposed at opposite ends of reflective tube 102. Or if the reflective tube 102 is mounted in an angled, tilted or vertical position, weep hole 202 is preferably located at a lower portion of reflective tube 102 where moisture would tend to accumulate.

Figure 3:
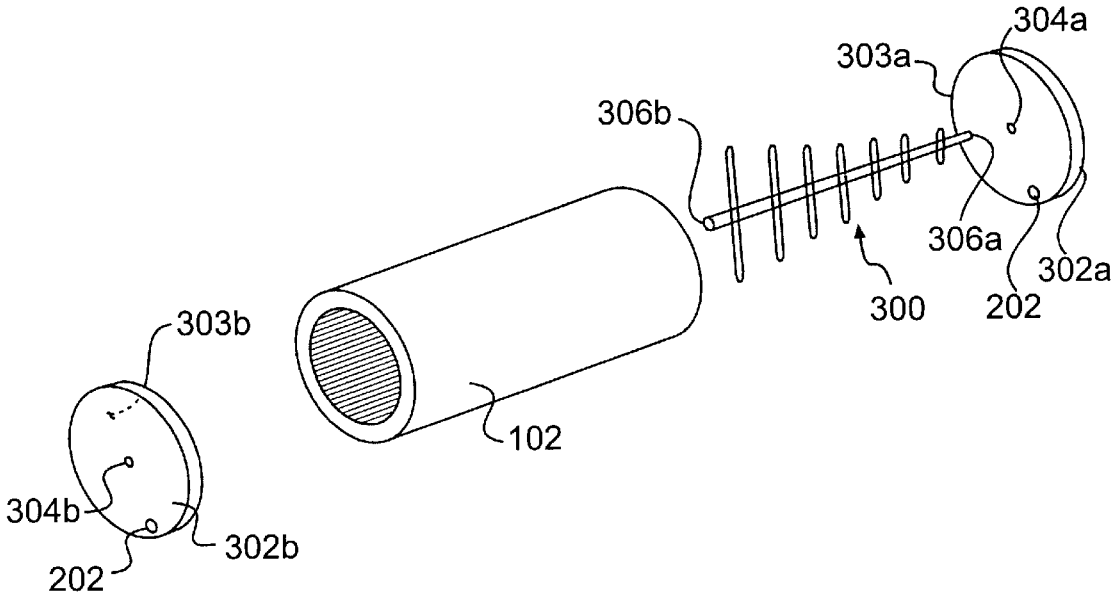
FIG. 3 is a schematic diagram of an exploded view of the preferred embodiment of the invention.

FIG. 3 is a schematic diagram of an exploded view of a preferred embodiment of the invention. Reflective tube 102 is designed to surround or enclose antenna 300. Reflective tube 102 is substantially continuous and it extends along antenna 300 longitudinally. Forward end cap 302*a* and rear end cap 302*b* are attached to opposite ends of reflective tube 102. End caps 302*a* and 302*b* preferably include provisions to hold antenna 300. Preferably a female member 304*a* is used to mate with male end portion 306*a* of antenna 300, and a female member 304*b* is used to mate with male end portion 306*b* of antenna 300. Female member 304*a* is preferably a hole disposed in forward end cap 302*a*, and female member 304*b* is preferably a hole disposed in rear end cap 302*b*. After assembly, end caps 302*a* and 302*b* assist in suspending antenna 300 within reflective tube 102 and preventing antenna 300 from contacting reflective tube 102. Forward end cap 302*a* has an interior side 303*a*, and rear end cap 302*b* has an interior side 303*b*. In another preferred embodiment, interior side 303*b* may be coated with reflective material 200. Interior side 303*a* is not coated.

Figure 4:
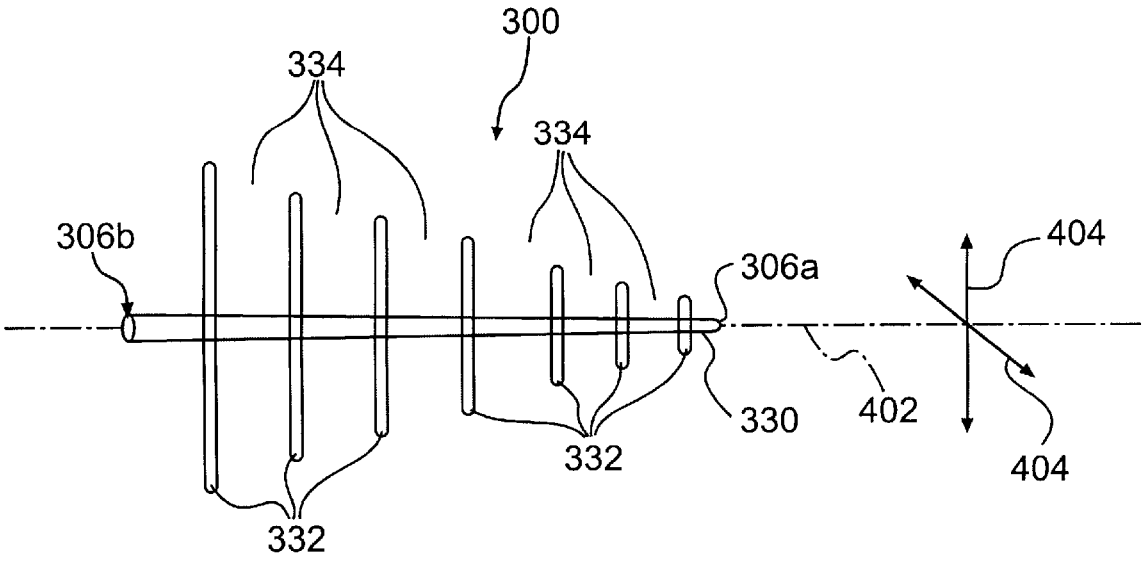
FIG. 4 is a schematic diagram of an enlarged side view of antenna 300 that is shown in FIG. 3.

FIG. 4 is a schematic diagram of an enlarged side view of antenna 300. Antenna 300 preferably comprises a backbone 330 with end portions 306*a* and 306*b*. Antenna 300 also includes elements 332. Preferably, antenna 300 includes more than one element. In an exemplary embodiment of the present invention, seven elements are used and the elements increase in size from one end to the other end. In between elements 332 are gaps 334.

For convenient reference, cylindrical coordinate names are used to describe the geometry of antenna 300. The long axis of backbone 332 is referred to as the axis 402 of antenna 300. Elements 332 extend in a radial direction 404, away from axis 402.

The invention preferably includes additional provisions that prevent antenna 300 from contacting reflective material 200 disposed within reflective tube 102. Additional suspension features, such as spacing members, may be employed to assist in suspending antenna 300 and preventing antenna 300 from contacting reflective material 200.

Figure 5:
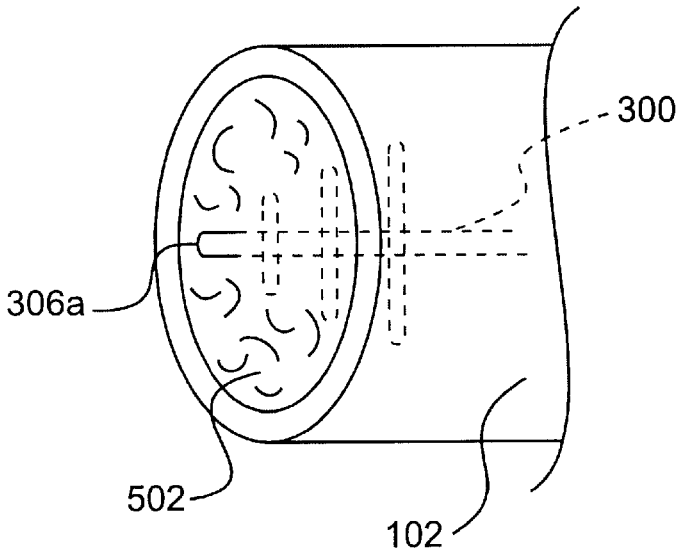
FIG. 5 is a schematic diagram of one embodiment of a spacing member.

FIG. 5 a schematic diagram of one embodiment of a spacing member. An expanding foam 502 is disposed inside reflecting tube 102. Expanding foam 502 encases antenna 300. Preferably, end portions 306*a* and 306*b* of antenna 300 extend beyond expanding foam 502 to mate with holes 304*a* and 304*b*, respectively. Expanding foam 502 surrounds antenna 300 and assists in preventing antenna 300 from contacting reflective material 200 of reflecting tube 102. Any suitable dielectric materials may be used as expanding foam 502. Most preferably, expanding foam 502 has a dielectric constant of one.

Figure 6:
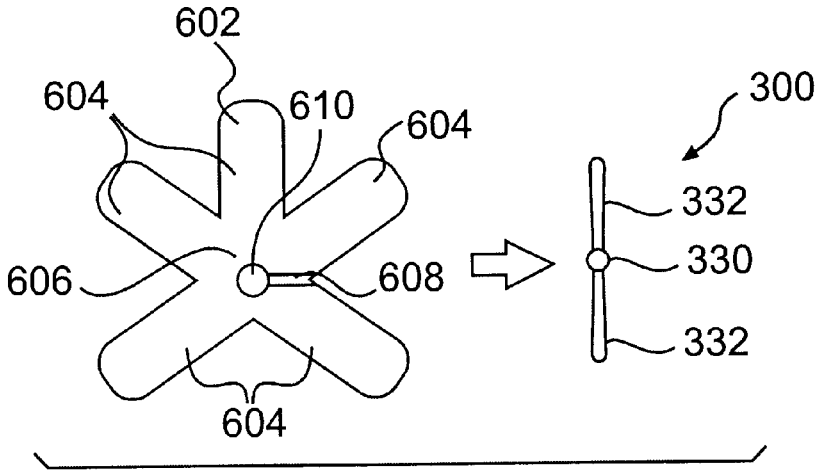
FIG. 6 is a schematic diagram of another embodiment of a spacing member.
Figure 7:
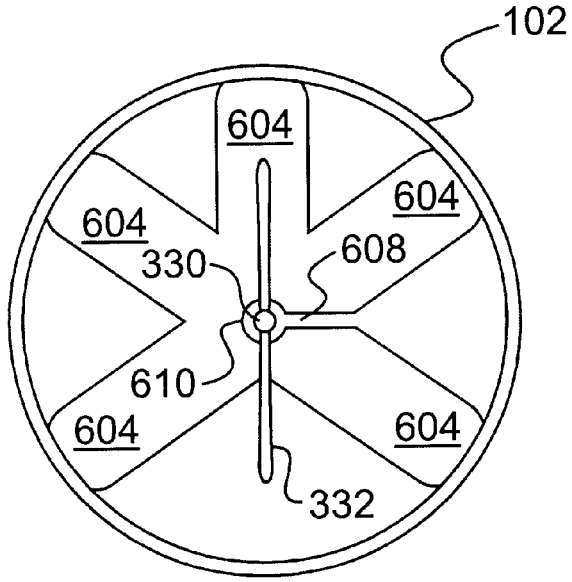
FIG. 7 is a schematic diagram of an elevation view of the spacing member shown in FIG. 6.

Another embodiment of a spacing member is shown in FIG. 6. A spoked member 602 is used as a spacing member. Any dielectric material may be used as spoked member 602. The suitable material also preferably has a low expansion/contraction coefficient. Common styrofoam is an example of a suitable dielectric material. Spoked member 602 includes extremities 604. Extremities 604 are designed to contact the inner surface of reflecting tube 102. Spoked member 602 also includes a central portion 606 designed to hold antenna 300. Central portion 606 includes a slot 608 and a hole 610. Central portion 606 is adapted to receive antenna 300 and engage antenna 300 at a gap 334 (see FIG. 4) between two elements 332. Spoked member 602 is moved radially towards a gap 334 (see FIG. 4) off antenna 300. Eventually, slot 608 of spoked member 602 contacts backbone 330 of antenna 300. Backbone 330 is slid further along slot 608 until backbone 330 reaches the central hole 610. At that point, the spoked member 602 is in the fully installed condition, shown in FIG. 7. Hole 610 is shown greatly enlarged for clarity. In the preferred embodiment, hole 610 tightly engages backbone 330, and no gap would be visible. In an exemplary embodiment, hole 610 is interference fit with backbone 330. In fact, spoked member 602 is preferably constructed of a resilient material and spokes 604 are interference fit within reflecting tube 102. In the exemplary embodiment, spoked member 602 is made of a lightweight material such as styrofoam. The degree of interference fitting and the selection of resilient materials can be adjusted so that the holding forces (both between the reflecting tube 102 and spokes 604 and between hole 610 and backbone 330) meet desired levels. One or several spoked members 602 may be used at different gaps 334 (see FIG. 4) of antenna 300.

Figure 8:
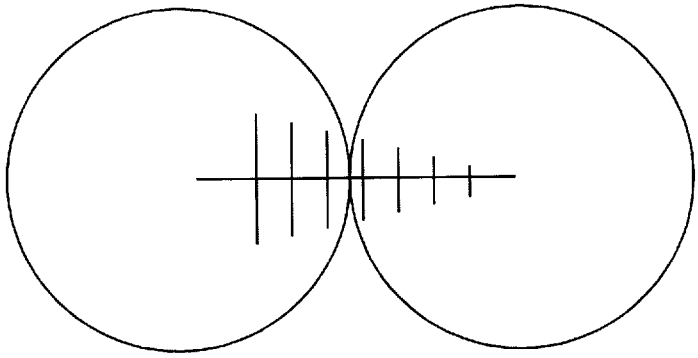
FIG. 8 PRIOR ART
FIG. 8 is a schematic diagram of a prior art antenna without a reflecting tube and the antenna lope shapes produced by the antenna.
Figure 9:
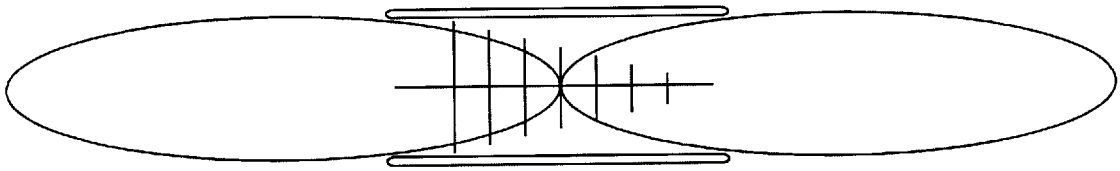
FIG. 9 is a schematic diagram of an antenna constructed according to the invention and the antenna lope shapes produced by the antenna.

After antenna 300 has been disposed within reflecting tube 102, dramatic differences in the antenna pattern can be observed. FIG. 8 is a schematic diagram of a prior art antenna without a reflecting tube. Note the regularly shaped lobes, representative of antenna patterns, radiating forwards and backwards along the axis of the antenna. Turning to FIG. 9, an antenna constructed according to the invention, produces very different lobe shapes. The reflecting tube dramatically decreases the size and extent of the side lobes, while, at the same time, dramatically increases the size and extent of the forward and rear lobes. In this way, an antenna according to the present invention, provides a highly directional antenna pattern and reduces the likelihood of interference from side lobes and subsequent saturation of the signal-processing device.

Directional antenna 100 has metallic paint as reflective material 200 disposed on reflective tube 102. Directional antenna 100 may be made using any known methods. For example, directional antenna 100 may be made as follows. First, reflective tube 102 is formed. Any known method of casting reflective tube 102 may be used. In the preferred embodiment in which reflective tube 102 is made of fiberglass, any known method of casting fiberglass articles may be used. Second, reflective tube 102 is coated with reflective material 200. In one preferred embodiment in which a metallic paint is used as reflective material 200, the interior side of reflective tube 102 is spray-painted with the metallic paint. Other methods of applying reflective material 200 on reflective tube 102 may be used. Third, one or more weep holes 202 may be created on reflective tube 102. Fourth, antenna 300 is inserted into reflective tube 102. Fifth, antenna 300 is suspended by a spacing member. As discussed above, a number of different materials may be used as the spacing member including expanding foam 502 and spoked member 602. Sixth, end caps 302*a* and 302*b* are attached to reflective tube 102.

Figure 10:
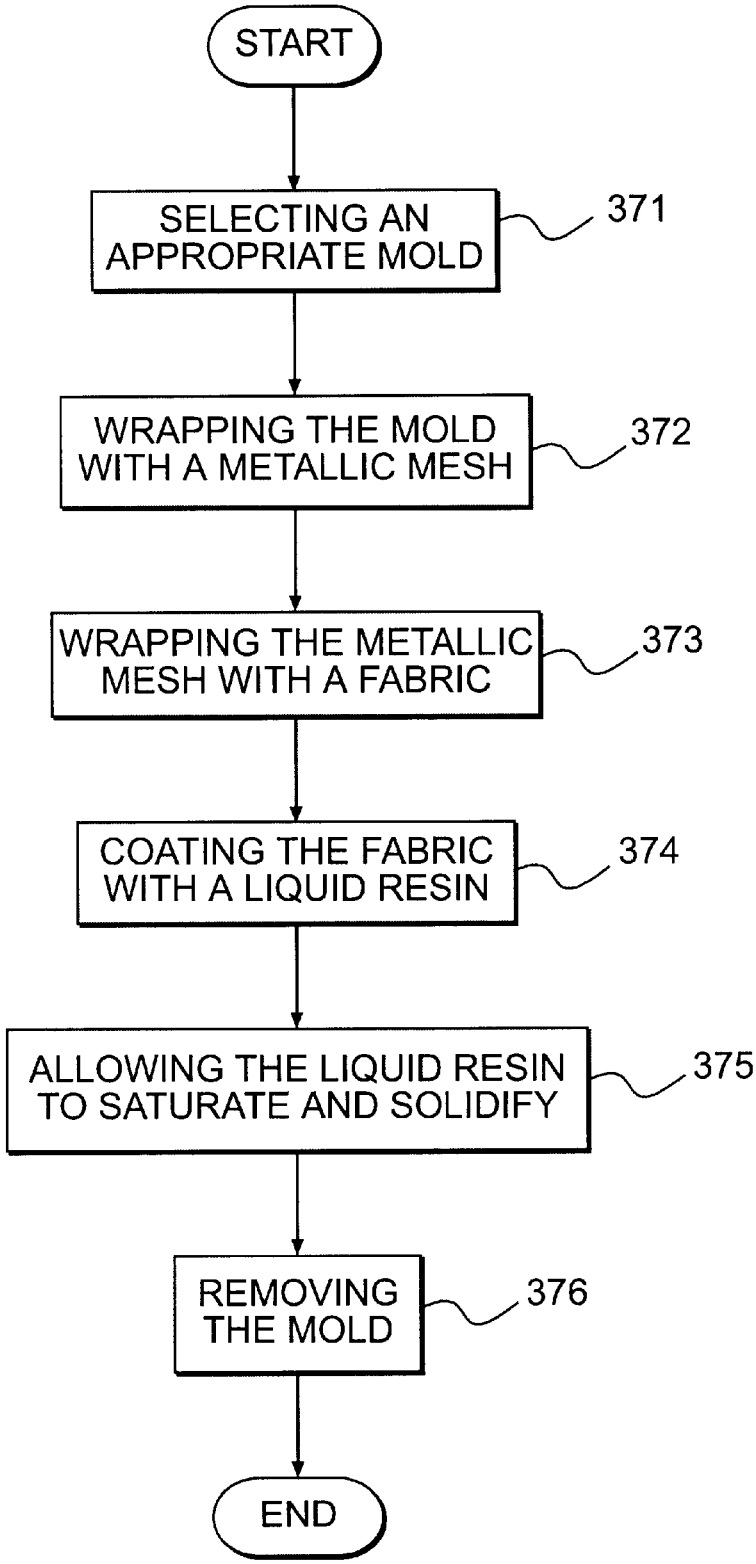
FIG. 10 is a flowchart illustrating the steps involved in making reflective tube 102 that has a metallic mesh as reflective material 200.

FIG. 10 is a flowchart illustrating the steps involved in making reflective tube 102 that has a metallic mesh as reflective material 200. The metallic mesh is the preferred material for reflective material 200. The aperture of the metallic mesh grids is a function of the frequency of operation of the antenna, and the aperture is dimensioned such that its reflective characteristics at that frequency are maximized. In step 371, an appropriate mold is selected. In the preferred embodiment in which reflective tube 102 has a cylindrical shape, PVC pipes may be used as the mold. The diameter of the mold is preferably larger than the longest member of elements 332 that is shown in FIG. 4. In step 372, a metallic mesh is wrapped around the mold. As discussed above, any suitable metallic mesh may be used. In step 373, the mold and the metallic mesh are wrapped with a fabric, preferably a fiberglass fabric. In step 374, a liquid resin is applied to coat and saturate the metallic mesh and the fabric. In the preferred embodiment, the liquid resin is that of a fiberglass compound. The liquid resin is then allowed to saturate and solidify in step 375. In step 376, the mold is removed. One or more weep holes 202 are then created on reflective tube 102.

Figure 11:
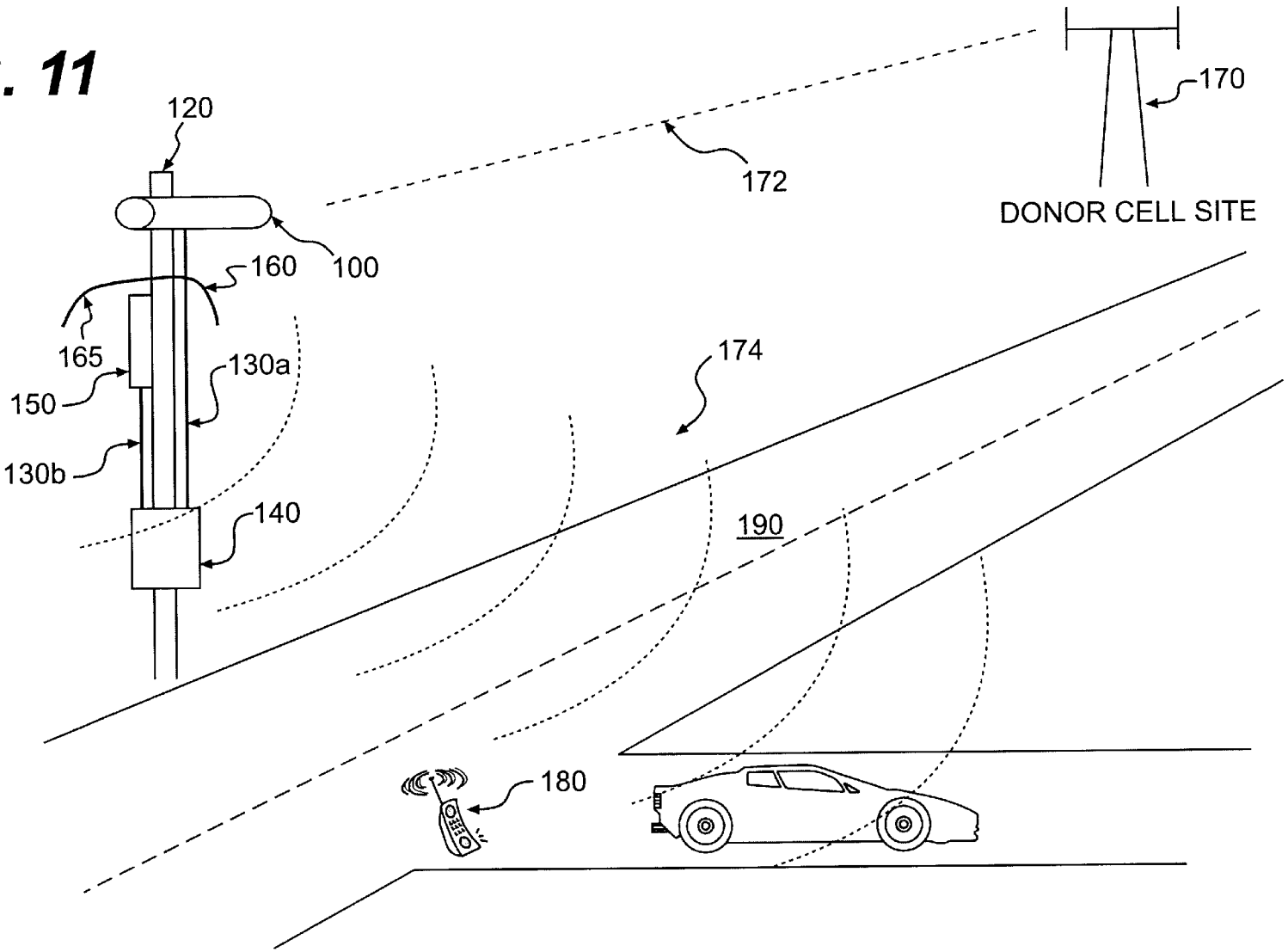
FIG. 11 is a schematic diagram showing one embodiment of using the invention with a transmission tower.

FIG. 11 is a schematic diagram showing one embodiment of using the invention with a transmission tower. In the embodiment shown in FIG. 11, utility pole 120 along roadway 190 is used as the transmission tower. In this embodiment, donor antenna 100 (a directional antenna), signal processing device 140, and coverage antenna 150 are mounted on utility pole 120. Donor antenna 100 is made in accordance with the present invention. Cable 130*a* connects donor antenna 100 to signal processing device 140. Signal processing device 140 could be an amplifier or a repeater, depending on whether the signals to be processed are analog or digital. Signal processing device 140 is connected to coverage antenna 150 by cable 130*b*. Reflecting shield 160 with underside 165 is placed between donor antenna 100 and coverage antenna 150. Underside 165 is preferably coated with reflective material 200. In this embodiment, donor antenna 100 is in wireless communication with donor cell site 170 via RF 172, and coverage antenna 150 is in wireless communication with wireless device 180 via RF 174.

Figure 12:
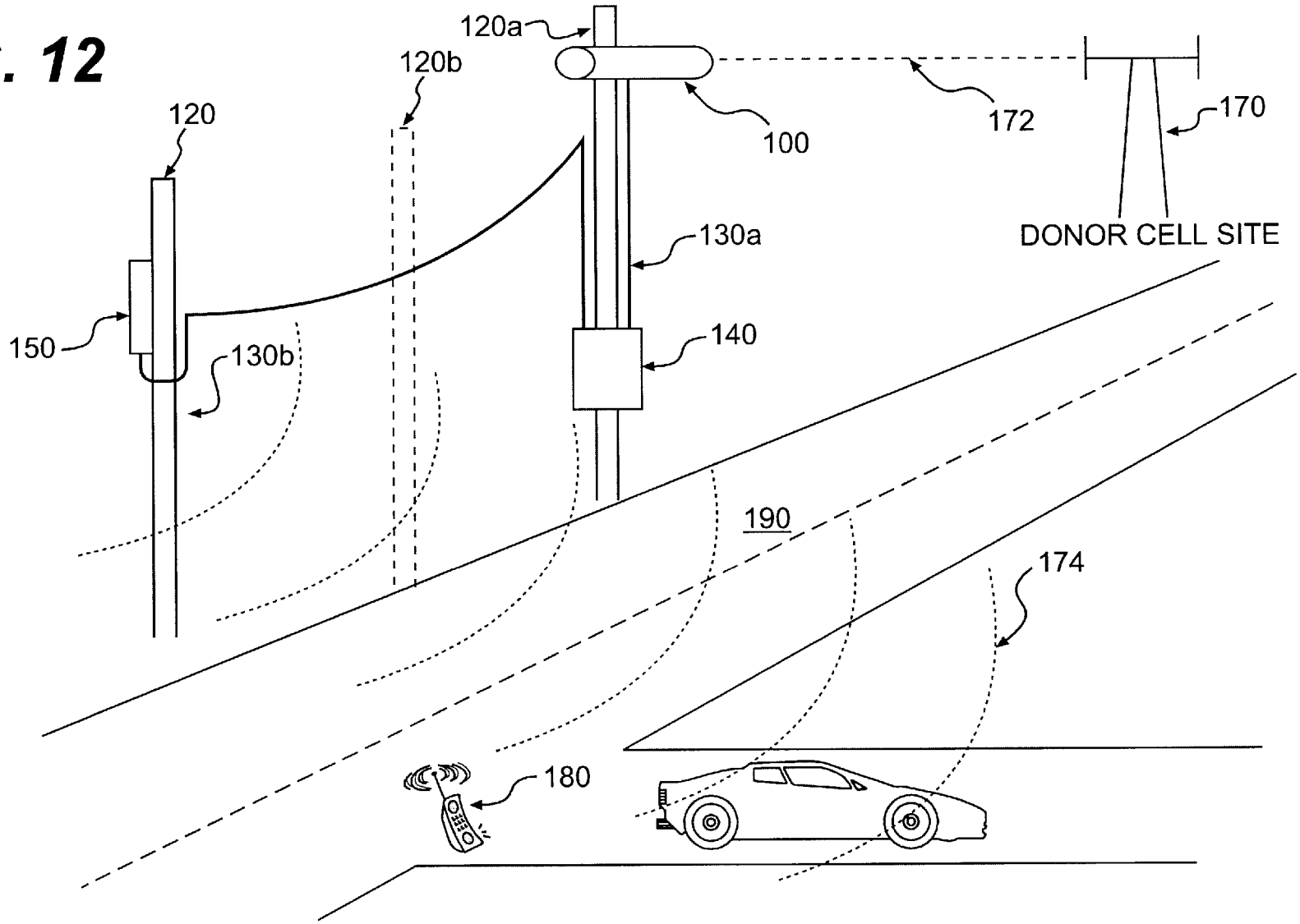
FIG. 12 is a schematic diagram showing a second embodiment of using the invention with multiple transmission towers.

FIG. 12 is a schematic diagram showing a second embodiment of using the invention with multiple transmission towers. In this embodiment, coverage antenna 150 is mounted on first utility pole 120. Donor antenna 100 and signal processing device 140 are mounted on second utility pole 120*a*. Signal processing device 140 may also be mounted on first utility pole 120. First utility pole 120 and second utility pole 120*a* may be two adjacent poles along roadway 190. In other embodiments, there may be at least one additional utility pole 120*b* between first utility pole 120 and second utility pole 120*a*. Donor antenna 100 is made in accordance with the present invention. Cable 130*a* connects donor antenna 100 to signal processing device 140. Signal processing device 140 could be an amplifier or a repeater, depending on whether the signals to be processed are analog or digital. Signal processing device 140 is connected to coverage antenna 150 by cable 130*b*. In this embodiment, donor antenna 100 is in wireless communication with donor cell site 170 via RF 172, and coverage antenna 150 is in wireless communication with wireless device 180 via RF 174.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

I claim:

1. An antenna comprising:

(a) an antenna member having at least one element and having a longitudinal axis, wherein the antenna member produces side lobes characterized by a size and an extent extending radially away from the longitudinal axis and forward and rear lobes characterized by a size and an extent along the longitudinal axis; and (b) a reflecting member surrounding the antenna member and not in contact therewith, wherein the reflecting member decreases the size and the extent of the side lobes and increases the size and the extent of the forward and rear lobes, wherein the reflecting member is substantially continuous and extends along the longitudinal axis.

2. The antenna according to claim 1, wherein the reflecting member is disposed on a housing and wherein the housing is substantially cylindrical.

3. The antenna according to claim 2, wherein the reflecting member is disposed on the cylindrical portion of the housing and wherein both axial ends of the housing permit penetration of radio waves.

4. The antenna according to claim 2, wherein the reflecting member is disposed on the cylindrical portion and on a first axial end of the housing, and wherein a second axial end of the housing permits penetration of radio waves.

5. The antenna according to claim 2, wherein the housing includes at least one weep hole.

6. The antenna according to claim 1, wherein the reflecting member is a metallic tape.

7. The antenna according to claim 1, wherein the reflecting member is a metallic mesh.

8. The antenna according to claim 1, wherein the reflecting member is a metallic paint.

9. An antenna comprising:

(a) an antenna member having at least one element and having a longitudinal axis, wherein the antenna member produces side lobes characterized by a size and an extent extending radially away from the longitudinal axis and forward and rear lobes characterized by a size and an extent along the longitudinal axis;

(b) a reflecting member surrounding the antenna member longitudinally and not in contact therewith, wherein the reflecting member decreases the size and the extent of the side lobes and increases the size and the extent of the forward and rear lobes; and (c) a spacing member disposed between the antenna member and the reflecting member.

10. The antenna according to claim 9, wherein the spacing member is an end cap disposed at an end of the reflecting member.

11. The antenna according to claim 9, wherein the spacing member is an expanding foam disposed within the reflecting member.

12. The antenna according to claim 11, wherein the expanding foam surrounds and encases the antenna member.

13. The antenna according to claim 9, wherein the spacing member is a spoked member with a central portion.

14. The antenna according to claim 13, wherein the spoked member includes at least one spoke extending radially outward from the central portion.

15. The antenna according to claim 13, wherein the central portion is adapted to receive the antenna member.

16. The antenna according to claim 15, wherein the central portion is adapted to receive a backbone of the antenna member at a gap between adjacent elements.

17. The antenna according to claim 15, wherein the central portion includes a slot and a hole adapted to receive a backbone of the antenna member.

18. The antenna according to claim 15, wherein the central portion is resilient and wherein the antenna member is interference fit within the central portion.

19. The antenna according to claim 13, wherein the spokes are resilient and wherein the spokes are interference fit within the reflecting tube.

* * * * *

UNITED STATES PATENT AND TRADEMARK OFFICE

CERTIFICATE OF CORRECTION

PATENT NO. : 6,351,248 B1
DATED : February 26, 2002
INVENTOR(S) : David A. Hill

It is certified that error appears in the above-identified patent and that said Letters Patent is hereby corrected as shown below:

Title page,
Item [73], the Assignee should read -- BellSouth Intellectual Property Corporation -- instead of "BellSouth Intellectual Property Management Corp."

Signed and Sealed this

First Day of April, 2003

JAMES E. ROGAN
*Director of the United States Patent and Trademark Office*